US006565288B1

(12) United States Patent
McCallion

(10) Patent No.: US 6,565,288 B1
(45) Date of Patent: May 20, 2003

(54) SOIL NAIL APPARATUS

(76) Inventor: James P. McCallion, 23352 Saint Elena, Mission Viejo, CA (US) 92691

( * ) Notice: Subject to any disclaimer, the term of this patent is extended or adjusted under 35 U.S.C. 154(b) by 0 days.

(21) Appl. No.: 09/454,831

(22) Filed: Dec. 6, 1999

Related U.S. Application Data

(60) Provisional application No. 60/110,936, filed on Dec. 5, 1998.

(51) Int. Cl.[7] ..... E21D 20/02

(52) U.S. Cl. ..... 405/259.5; 405/262; 405/272

(58) Field of Search ..... 405/259.1, 259.5, 405/262, 272, 288, 302.2

(56) References Cited

U.S. PATENT DOCUMENTS

| | | | | | |
|---|---|---|---|---|---|
| 3,807,182 | A | * | 4/1974 | Schnabel, Jr. | |
| 4,012,883 | A | * | 3/1977 | Muller | 405/259.1 |
| 4,069,677 | A | * | 1/1978 | Yamada et al. | 405/259.5 |
| 4,411,557 | A | * | 10/1983 | Booth | 405/262 |
| 4,472,088 | A | * | 9/1984 | Martin | 405/259.1 |
| 4,648,753 | A | * | 3/1987 | Stephan | 405/259.5 |
| 4,850,746 | A | * | 7/1989 | Finsterwalder et al. | 405/259.5 |
| 4,904,122 | A | * | 2/1990 | Herbst et al. | 405/259.1 |
| 4,971,493 | A | * | 11/1990 | Herbst et al. | 405/259.1 |
| 4,984,937 | A | * | 1/1991 | Karpellus | 405/259.1 |
| 5,147,151 | A | * | 9/1992 | Hipkins, Jr. | 405/259.1 |
| 5,273,377 | A | * | 12/1993 | Taylor | 405/259.5 |
| 5,314,268 | A | * | 5/1994 | Calandra, Jr. et al. | 405/259.5 |
| 5,511,909 | A | * | 4/1996 | Calandra, Jr. et al. | 405/259.1 |
| 5,570,976 | A | * | 11/1996 | Fuller et al. | 405/302.2 |
| 5,603,589 | A | * | 2/1997 | von Allmen et al. | 405/302.2 |
| 5,622,454 | A | * | 4/1997 | Ashmore et al. | 405/259.5 |
| 5,791,824 | A | * | 8/1998 | Radtke | 405/259.5 |
| 5,919,006 | A | * | 7/1999 | Calandra, Jr. et al. | 405/302.2 |
| 5,954,455 | A | * | 9/1999 | Eaton et al. | 405/302.2 |

FOREIGN PATENT DOCUMENTS

| | | | | | |
|---|---|---|---|---|---|
| GB | 2115861 | A | * | 3/1993 | 405/259.5 |

OTHER PUBLICATIONS

Synthesis Report On Soil Nail Wall Facing Design, submitted by Golder Associates Inc., 4014—148th Avenue NE, Redmond, WA 98152.

* cited by examiner

*Primary Examiner*—Thomas B. Will
*Assistant Examiner*—Alexandra K. Pechhold
(74) *Attorney, Agent, or Firm*—Myers Dawes & Andras; Joseph C. Andras; Vic Y. Lin

(57) ABSTRACT

A method and a structure for stabilizing a formation of natural substrate having a substantially vertical face. A tendon is inserted into a hole in the formation. A heading device includes a plate, a tube, an adhesive material within the tube, and an anchor. The plate has a bore disposed over a protruding portion of the tendon. The tube is disposed over the protruding portion of the plate. An adhesive material is disposed within the tube to couple the tendon to the tube. The anchor is coupled to the plate. A final concrete facing is placed over the entire heading device embedding the anchor.

34 Claims, 5 Drawing Sheets

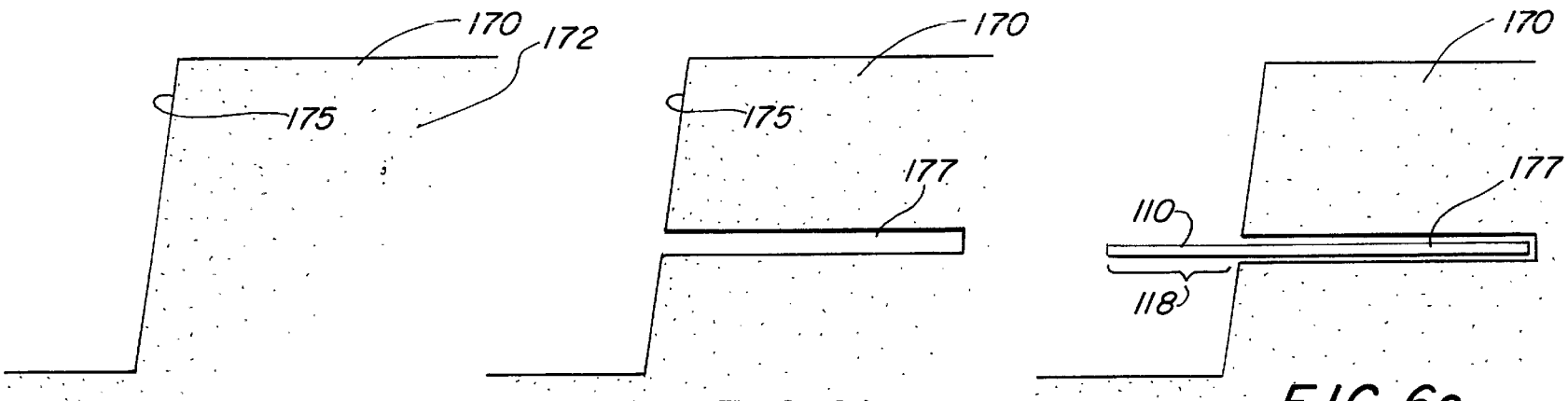
FIG. 6a
FIG. 6b
FIG. 6c
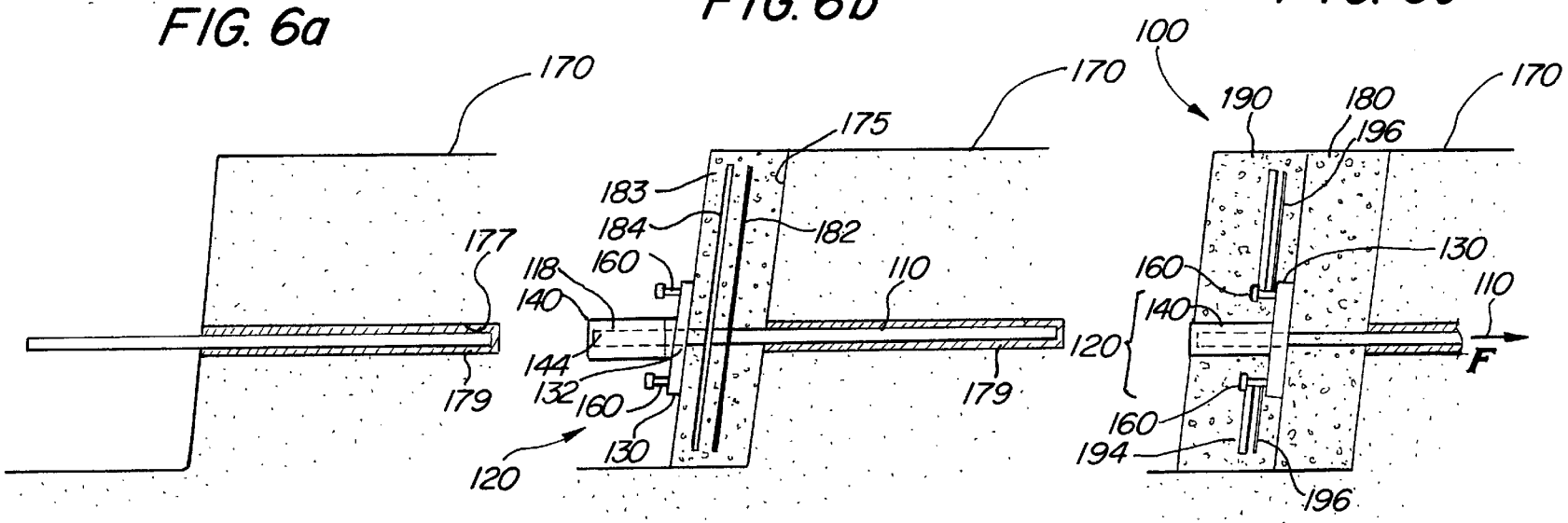
FIG. 6d
FIG. 6e
FIG. 6f

SOIL NAIL APPARATUS

This application claims the benefit of No. 60/110,936, filed Dec. 5, 1998.

BACKGROUND OF THE INVENTION

1. Field of the Invention

The invention relates generally to applications in the construction industry known as "tie backs", or "soil nailing".

2. Description of Related Art

Formations of natural substrate, such as hills of rocks or soil, have been known to undergo slides and sloughing over as a result of a disturbance. This disturbance may be natural, such as an earthquake, surface and subsurface water action, or manmade, such as vehicular traffic. For example, excessive rainfall may cause mudslides in which dirt and other natural substrate of a hill slough over onto adjacent land. This phenomena occurs not only with natural occurring formations, but with artificial, manmade formations as well, such as excavations created for building foundations or easements for roadways. Unless the vertical faces of these formations are stabilized, retained or held back, the formations may very well collapse leading to catastrophic results.

Tie backs or soil nails are used to restrain, stabilize, retain, or hold back a substantially vertical face of a formation of natural substrate in order to prevent the natural substrate from sloughing over. Therefore, it is crucial that a soil nail, or tie back, structure be capable of restraining a natural formation without any compromise in strength and endurance.

SUMMARY OF THE INVENTION

In accordance with the present invention, a structure and associated method are disclosed. The invention comprises both a structure and an associated method for stabilizing a formation having a substantially vertical face.

In one aspect, the invention comprises a soil nail apparatus, or system. The soil nail apparatus comprises a tendon, a plate, a tube, an adhesive material, and an anchor. The plate has a bore through which the tendon extends. The bore has a bore diameter. The tube is disposed adjacent to the bore of the plate such that a portion of the tendon extends through the bore of the plate and into the tube. The tube has an outer diameter greater than the bore diameter. The adhesive material is disposed within the tube. The anchor is coupled to the plate.

The tendon may comprise a metallic or non-metallic material. The plate, tube, and anchor may each comprise a non-metallic material. The non-metallic material of the soil nail apparatus comprises a fiber reinforced polymer, or FRP, material. The fiber reinforced polymer material comprises a suitable reinforced fiber and a suitable resin formed into a structural matrix wherein the type of reinforced fiber and the type of resin is a function of the intended environment of use. The tendon may comprise a single strand or multiple strands of a fiber reinforced polymer material. The tendon comprises a non-threaded surface. The tendon may include a smooth or deformed surface.

The bearing plate and the tube may also comprise a non-metallic material, such as a fiber reinforced polymer material. The tube includes a plurality of injection ports defined in a side wall. An inner surface of the tube may be deformed to increase adhesion to the adhesive material. The tube, may include an end cap with an exit aperture.

The adhesive material comprises a chemical anchoring material, such as epoxy. The adhesive material also comprises cementitious grout. The anchor comprises a headed stud coupled to a far surface of the plate.

The soil nail apparatus further comprises a final concrete facing encapsulating the tube, the plate, and the anchor.

In another aspect, the invention comprises a heading device that is adapted for securing a soil nail. The heading device comprises a non-metallic plate, a non metallic tube, an adhesive material, and a non-metallic anchor.

The non-metallic plate has a near surface, a far surface, and a bore with a bore diameter. The hollow non-metallic tube has an outer diameter greater than the bore diameter. The tube is disposed adjacent to the far surface and the bore of the plate. The adhesive material is disposed within the tube. The non-metallic anchor is coupled to the far surface of the plate. The non-metallic anchor comprises a headed stud. The headed stud may also be attached to a second: plate separate from the plate through which the tendon extends. The non-metallic plate, the non-metallic tube, and the non-metallic anchor may each comprise a fiber reinforced polymer material.

The invention further comprises methods for stabilizing a formation having a substantially vertical face. In one aspect, a method comprises: forming a hole into the formation via the substantially vertical face; inserting a tendon into the hole with an exposed portion of the tendon protruding out from the hole; filling the hole with grout; placing a plate over the exposed portion of the tendon; disposing a tube over the exposed portion of the tendon; and filling the tube with an adhesive material.

The method further comprises the following, each of which may be practiced in combination with or separately from the others: deforming a surface of the tendon; deforming an inner surface of the tube; forming the tendon out of a fiber reinforced polymer material; forming the tendon comprises grouping multiple strands of a fiber reinforced polymer material; and placing a final concrete facing over the plate, tube, and stud.

Forming the hole in the formation comprises drilling into the vertical face of the formation. Filling the tube with an adhesive material comprises injecting the adhesive material into the tube via injection ports on a side wall of the tube, or placing adhesive material into the tube prior to disposing the tube over the exposed portion of the tendon.

In another aspect, the invention comprises an additional method for stabilizing a formation having a substantially vertical facing. The method comprises: inserting a soil nail into a hole in the formation via the vertical facing; exerting load into the hill formation with the soil nail; transferring load from the soil nail to an adhesive material disposed on a portion of the soil nail protruding from the hole in the formation; transferring load from the adhesive to a tube disposed over the protruding portion of the soil nail; and transferring load from the tube to a plate disposed adjacent to the soil nail.

The method further comprises the following: transferring load from the plate to an anchor coupled to the plate; transferring load from the anchor to a final concrete facing embedding the anchor; and transferring load from the final concrete facing toward the vertical facing of the hill formation.

The invention, now having been briefly summarized,,may be better visualized by turning to the following drawings wherein like elements are referenced by like numerals.

BRIEF DESCRIPTION OF THE DRAWINGS

FIG. 6*a* is a side view of a formation;

FIG. 6*b* is a side view of a formation with a hole formed therein;

FIG. 6*c* is a side view showing a tendon inserted into the hole of the formation;

FIG. 6*d* is a side view illustrating grout disposed in the hole of the formation;

FIG. 6*e* is a side view illustrating a heading device installed;

FIG. 6*f* is a side view illustrating the soil nail system 100 in an operative configuration with the formation.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Figure 1:
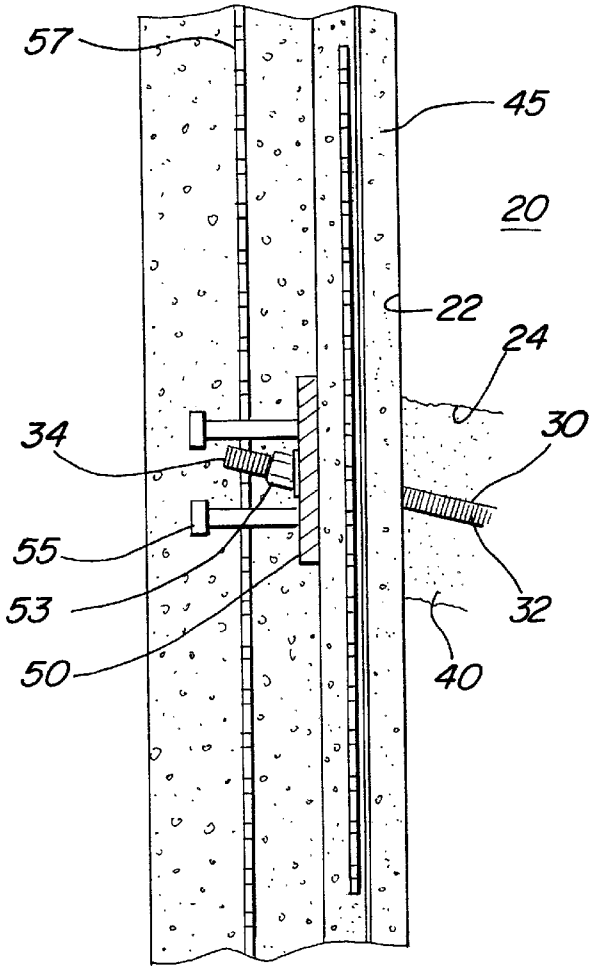
FIG. 1 PRIOR ART
FIG. 1 is an excerpt from a Federal Highway Administration document entitled "FHWA Soil Nailing Demonstration Project 103" illustrating the prior art.

FIG. 1 illustrates a prior art soil nail structure. A formation 20 of natural substrate has a vertical face 22. A hole 24 is drilled into the formation via the vertical face 22. Holes of this nature can extend to 40 feet or more. The prior art consists of a metallic soil nail 30 that is inserted to the hole 24. The metallic soil nail 30 has a threaded surface 32 so as to engage the cementitious grout 40 that fills the remainder of the hole 24. A portion 34 of the nail 30 extends out from the hole 24. A temporary shotcrete facing 45 may be optionally installed over the vertical face 22 of the formation 20. The temporary shotcrete facing 45 may include a mesh reinforcement 47 and vertical bearing bars 49. A metallic plate 50 has a bore (not shown). The plate 50 is placed over the portion 34 of the nail 30 with the nail extending through the bore. A nut 53 is screwed onto the portion 34 of the nail 30 so as to secure the plate 50 against the temporary shotcrete facing 45. Headed studs 55 are attached to the plate 50. A final concrete facing 57 is placed against the temporary shotcrete facing 45. The final concrete facing 57 encapsulates the plate 50, the headed studs 55, the portion 34 of the nail 30 and the nut 30.

Figure 2:
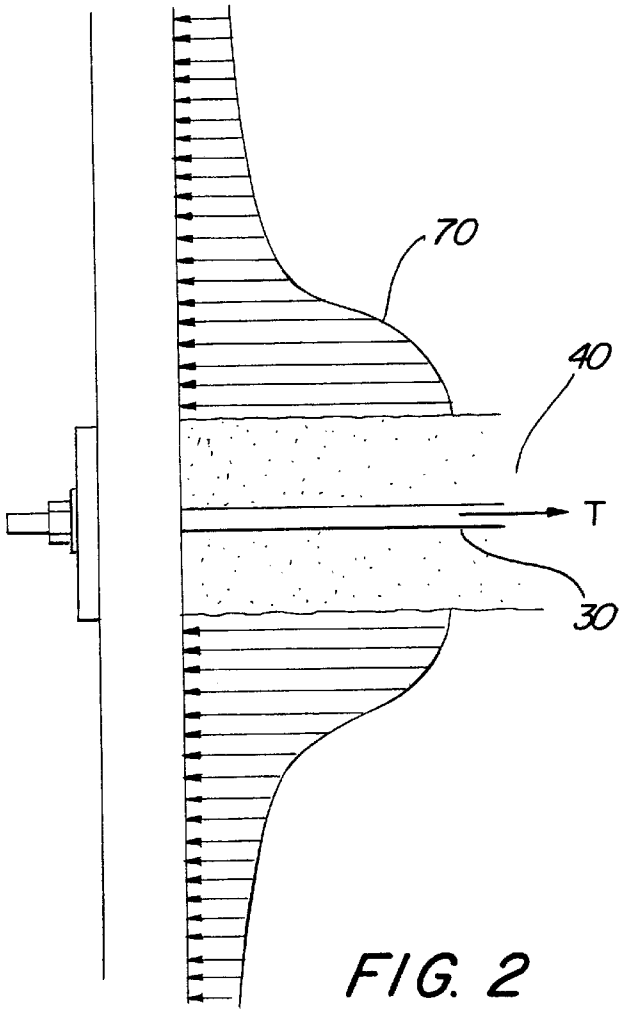
FIG. 2 PRIOR ART
FIG. 2 is an excerpt from the Federal Highway Administration document entitled "FHWA Soil Nailing Demonstration Project 103" illustrating the forces at work in a prior art soil nail system.

FIG. 2 is a diagram illustrating the forces exerted by a substantially vertical formation on a prior art soil nail system. The sinusoidal curve 70 is peaked adjacent to the grout 40 and nail 30, thus showing the pressure build-up adjacent to the tensile loading T provided by the nail versus the reduction in pressure of the soil as distance from the nail increases. Thus, the soil nail system acts to restrain the soil at its peak in the region closest in proximity to the nail embedded in grout.

The present invention includes a structure and associated method, for stabilizing a formation. The structure is described as a soil nail apparatus, or system, and will be generally designated in the figures by the numeral 100. As used herein, words such as "near" and "far" which are used to describe directions relative to a hill formation. Thus, the "near" direction or position is toward the formation. In contra-distinction, "far" refers to a direction or position away from the formation.

Figure 3A:
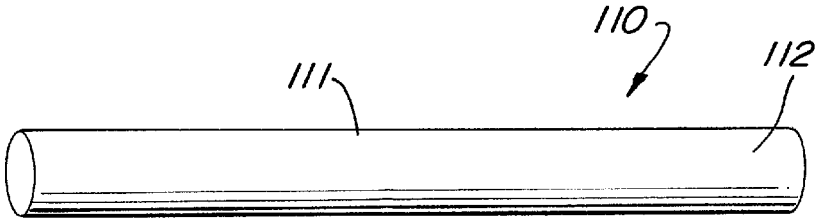
FIG. 3*a* is a perspective view of a smooth tendon.
Figure 3B:
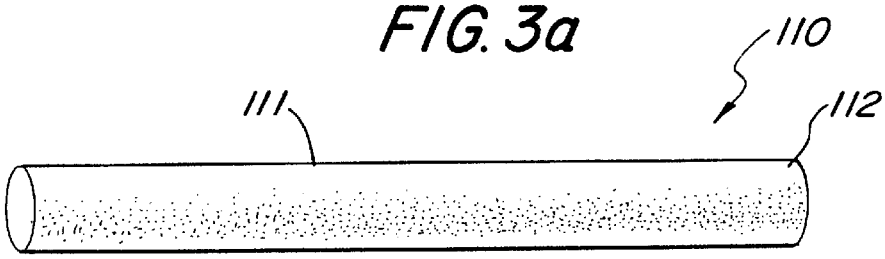
FIG. 3*b* is a perspective view of a tendon having a deformed surface.

FIG. 3*a* is a perspective view of a tendon 110 according to the present invention. The tendon 110 has a non-threaded surface 112. In the preferred embodiment, the tendon 110 comprises a non-metallic material which includes, among others, a fiber reinforced polymer, also known as "FRP", material. The FRP material comprises a suitable reinforced fiber and a suitable resin formed into a structural matrix wherein the type of reinforced fiber and the type of resin is a function of the intended environment of use. However, the tendon 110 may also comprise a metallic material, such as steel. In FIG. 3*a,* the non-threaded surface 112 is shown to be smooth which is the initial state of a tendon when first produced. In FIG. 3*b,* however, the tendon 110 may have a deformed surface 112 which is a surface that is not smooth. To achieve a deformed surface 112, the entire length of the tendon 110 may be treated with abrasive materials or other means. The deformed surface 112 increases the bonding between the surface 112 of the tendon 110 and any neighboring material, such as grout or adhesive material which is described further below. In the preferred embodiment, the diameter of the strand 111 is roughly 1 inch, although the diameter may vary widely.

Figure 3C:
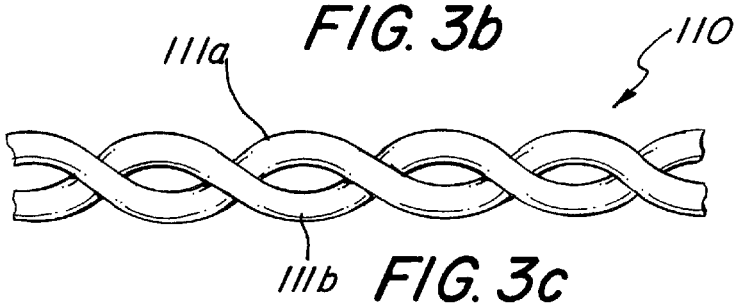
FIG. 3*c* is a side elevation view of a tendon comprising multiple strands.

The tendon 110 may comprise a single strand 111 of FRP as shown in FIGS. 3*a* and 3*b,* or multiple strands 111*a,* 111*b* as shown in FIG. 3*c*. In FIG. 3*c,* the tendon 110 comprises a plurality of strands 111*a,* 111*b* intertwined in a helical orientation to form a single tendon. Though FIG. 3*c* illustrates only two strands, it is to be expressly understood that a single tendon may comprise two or more strands.

Figure 4:
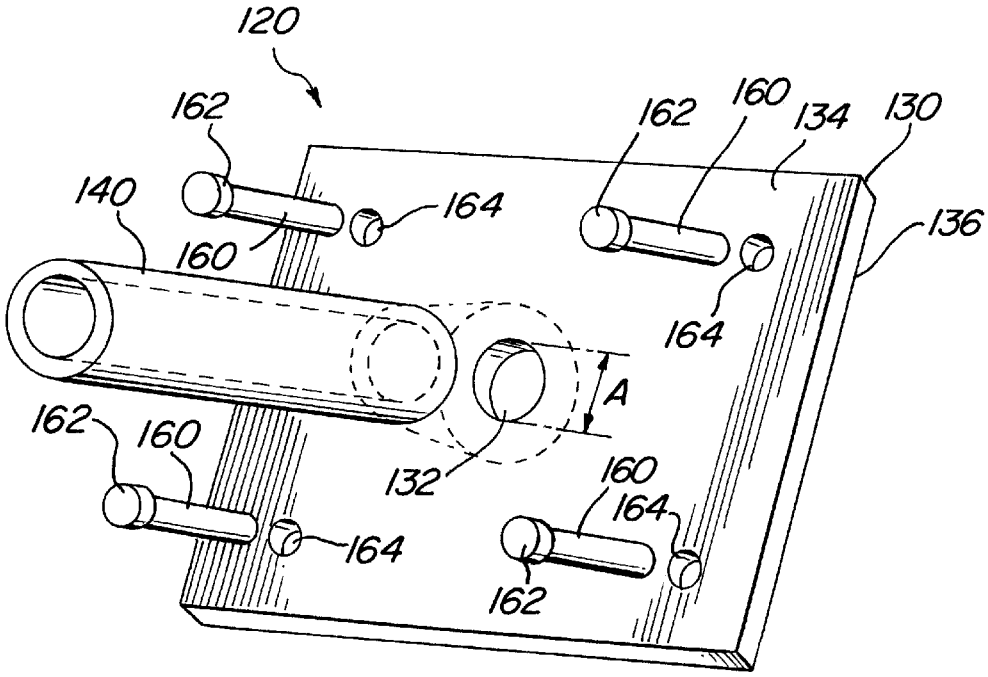
FIG. 4 is an exploded view of a heading device.

FIG. 4 is an exploded view of a heading device 120. The heading device 120 includes a bearing plate 130 having a far surface 134 and an opposite near surface 136, and a bore 132 extending through the plate 130 to open to the two surfaces 134, 136. The bore 132 has a bore diameter "A" that is at least as great as a diameter of a tendon so as to allow the tendon to extend therethrough. A hollow tube 140 is disposed adjacent to the bore 132 so as to receive a portion of the tendon extending through. The hollow tube 140 may be integral with or separate from the plate 130. The heading device 120 further comprises an anchor: 160. The anchor 160 may include a plurality of headed studs 160 that each include a head 162 so as to be embedded in a final concrete facing. The headed studs 160 are received in recesses 164 defined in the outboard surface 134 of the plate 130 through the use of an adhesive material. Alternatively, the headed studs 160 may be attached to a second plate separate from the bearing plate 130. It is to be expressly understood that a variety of mechanisms may serve as an anchor. For instance, the tube 140 itself may include a flange. In the preferred embodiment, the entire heading device 120, including the bearing plate 130, the tube 140, and the headed studs 160, comprises a non-metallic material. Such a non-metallic material includes FRP which is also non-magnetic and electrically insulating.

Figure 5A:
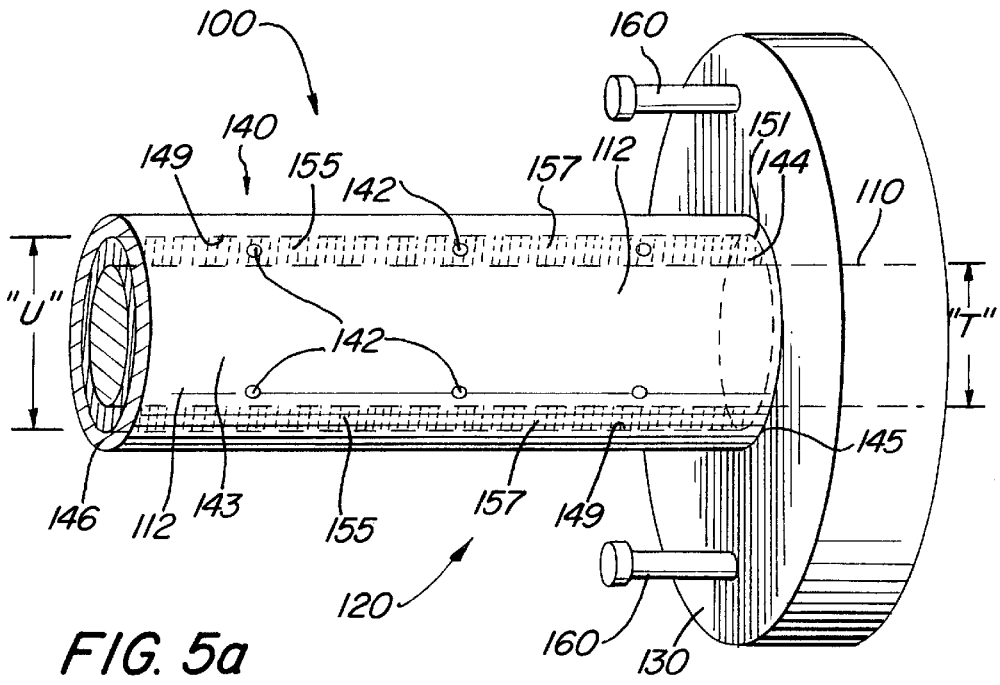
FIG. 5*a* is a perspective view of the soil nail system 100 with hidden view lines to show the interrelationship of the various components.
Figure 5B:
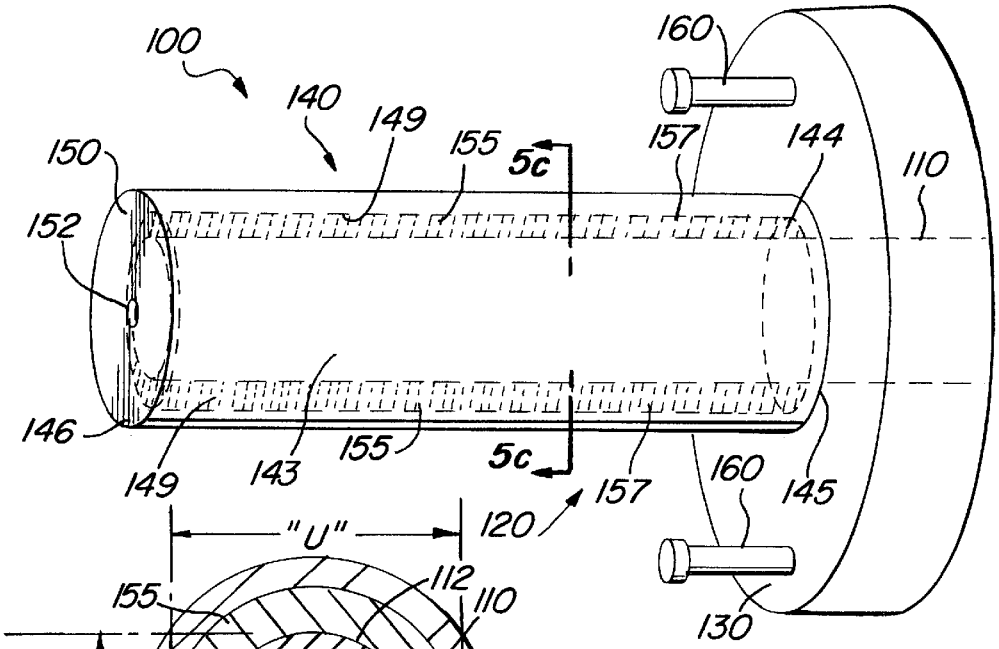
FIG. 5*b* is a perspective view of the soil nail system 100 showing an alternate embodiment of the tube.
Figure 5C:
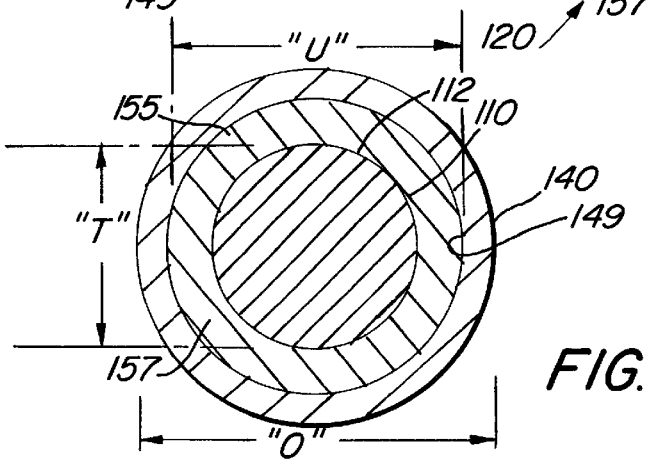
FIG. 5*c* is a cross-sectional view taken along lines 5*c*—5*c* of FIG. 5*b*

FIG. 5*a* is a perspective view of a heading device 120 placed over a tendon 110. An opening 151 exists on the near end 145 of the tube to receive the tendon 110. In this embodiment, the tube 140 has a plurality of injection ports 142 defined in the side wall 143. The injection ports 142 enable adhesive material 155, such as epoxy, to be inserted into the interior channel 144 of the tube 140 to contact the tendon 110 received therein. As shown in FIGS. 5*a* and 5*c,* the tube 140 has an inner diameter "U" that is greater than an outer diameter "T" of the tendon 110 such that an annular gap 157 lies between the surface 112 of the tendon 110 and an inner surface 149 of the tube 140. The difference between the outer diameter "T" and the inner diameter "U" defines the thickness of the side wall 143 of the tube 140. The adhesive material 155 is thus disposed in the annular gap 157. The inner surface 149 of the tube 140 as well as the surface 112 of the tendon may be deformed, or roughened, for better adhesion to the adhesive material 155. The tube 140 has a near end 145 and a far end 146. In this embodiment, the adhesive material 155 is injected into the tube 140 which is placed over the tendon 110.

Alternatively, the adhesive material 155 may be placed into a tube 140 prior to installing the tube over a tendon. FIG. 5*b* is a perspective view of an alternate embodiment of a tube 140 wherein an end cap 150 at a far end 146 includes an exit aperture 152, but the side wall 143 does not include injection ports. Thus, to couple the tube 140 to the tendon 110, adhesive material 155 is first put into the tube 140 prior to placing the tube 140 over a tendon. The exit aperture 152 allows excess adhesive material 155 to escape out from the interior channel 144 once the tendon 110 is received within the channel 144.

FIG. 5*c* is a cross sectional end view taken along lines 5*c*—5*c* of FIG. 5*b*. In FIG. 5*c,* the tube 140 has an outer diameter "O" and an inner diameter "U". An example of an outer diameter "O" would be 1.5 inches while the inner diameter "U" would be 1.25 inches. An example of a diameter "T" of the tendon 110 would be 1 inch. In such an example, the annular gap 157 would be roughly 0.125 inch in radial distance from the surface 112 of the tendon to the inner surface 149 of the tube 140. The adhesive material 155 is disposed in the annular gap 157, thus contacting the inner surface 149 of the tube 140 and the surface 112 of the tendon 110.

FIGS. 6*a–f* are sectional side views illustrating the structure of the soil nail system 100 and the method of stabilizing a hill formation using the present invention. FIG. 6*a* shows a formation 170 of natural substrate 172 having a substantially vertical face 175. In FIG. 6*b,* a hole 177 is formed into the formation 170 by drilling through the vertical face 175. The hole 177 have a substantial depth of 40 feet or longer. In FIG. 6*c,* a tendon 110 according to the present invention is inserted into the hole 177. The tendon 110 has a length greater than the depth of the hole 177 such that a portion 118 of the tendon 110 extends out from the hole 177 as shown in FIG. 6*c*. In FIG. 6*d,* the hole 177 is then filled with grout 179. The grout 179 comprises a cementitious material. As illustrated in FIG. 3*b,* the tendon 10 have a deformed surface 112 to better bond with the encapsulating grout 179 in the hole 177.

FIG. 6*e* illustrates the assembly of the heading device 120 onto the tendon 110. In FIG. 6*e,* a temporary shotcrete facing 180 may be disposed against the vertical face 175 of the formation 170. However, this temporary shotcrete facing 180 is optional. The temporary shotcrete facing 180 may include a mesh reinforcement 182 disposed vertically within the shotcrete material 183 as well as vertical bearing bars 184.

The bearing plate 130 according to the present invention is placed against the shotcrete facing 180 with the protruding portion 118 of the tendon extending through the bore 132 of the plate 130. It is to be expressly understood that should the optional shotcrete facing 180 not be installed, the plate 130 would simply rest against the vertical face 175 of the formation 170. The tube 140 is placed over the protruding portion 118 of the tendon 110 with a chemical adhesive, or anchoring, material disposed within the channel 144 of the tube as shown in FIGS. 5*a* and 5*b*. The chemical adhesive material may be injected into the tube 140 subsequent to the placement of the tube over the tendon via injection ports. Alternatively, the chemical adhesive material may first be placed into the tube 140 prior to placement of the tube 140 over the tendon, in which case the end cap 150 of the tube 140 includes an exit aperture 152 for excess adhesive material to escape out from the channel 144 of the tube. The interior surface of the tube may be deformed to increase adhesion to the adhesive material.

Headed studs 160 are received into recesses defined in the far surface 134 on the plate 130, which is also illustrated in FIG. 4.

In FIG. 6*f,* a final concrete facing 190 is placed over either the shotcrete facing 180 or, if a shotcrete facing is absent, the vertical face 175 of the formation 170. The final concrete facing 190 comprises "cast in place", or CIP, concrete. The final concrete facing 190 may include a plurality of vertical reinforcement bars 194 and mesh 196, both of which may be disposed on a near or far side of the headed studs 160. The final concrete 190 encapsulates the entire heading device 120, including the tube 140, the plate 130, and the studs 160. The studs 160 serve to anchor into the final concrete facing 190.

Figure 8:
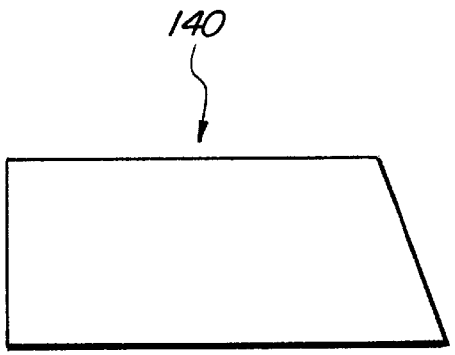
FIG. 8 is a side elevation view of a beveled tube.
Figure 7:
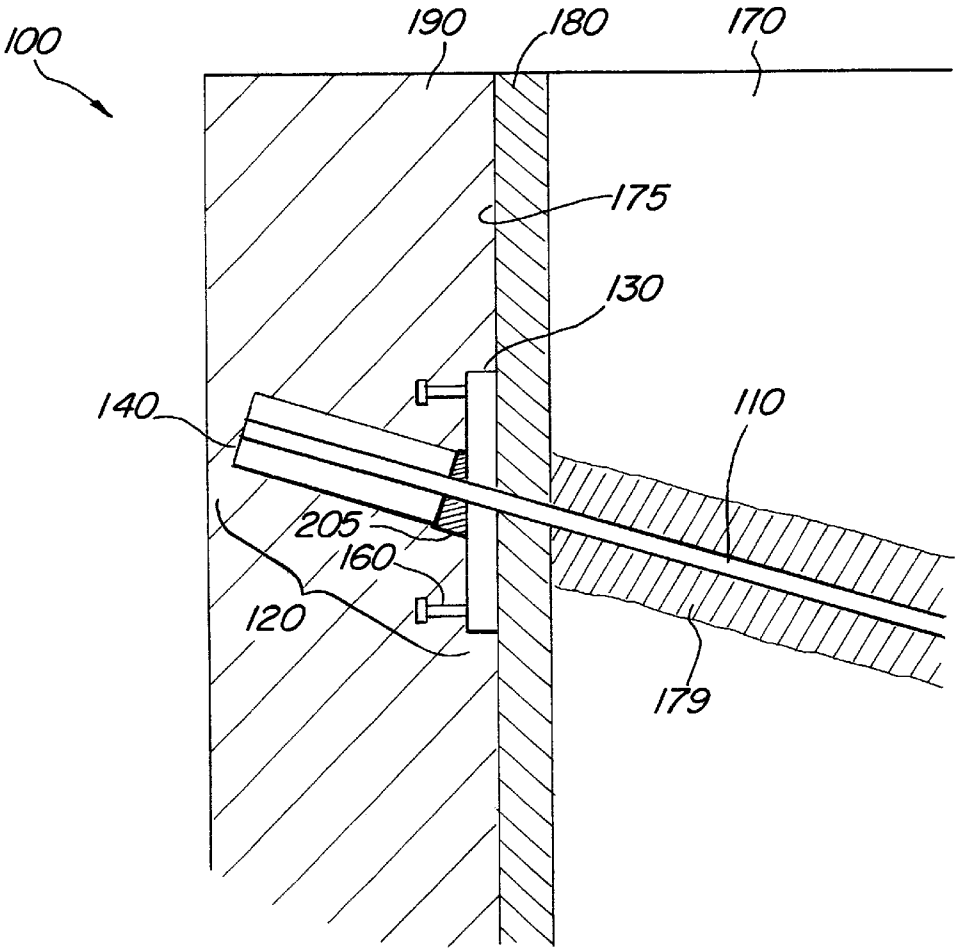
FIG. 7 is a side view illustrating the soil nail system 100 in an operative configuration with a vertical face of a formation and a tendon in a declining orientation.

In the instance where the tendon 110 is not perpendicular to the face 175 of the formation, such as when the tendon 110 is horizontal but the face 175 is slightly sloped tie from the vertical as shown in FIGS. 6*a–f,* or when the face 175 is vertical but the tendon 110 is slightly angled downward into the formation 170 as shown in FIG. 7, a beveled washer 205 may be disposed between the tube 140 and the plate 130 to accommodate the angle of the tendon relative to the face 175. FIG. 7 illustrates a soil nail structure 100 substantially similar to the soil nail structure 100 shown in FIG. 6*f* wherein like elements are referenced by like numerals. The primary differences in FIG. 7 are the orientation of the elements due to the vertical face 175 and the slightly declining tendon 110, and the addition of the beveled washer 205 to accommodate this angular disposition of the tendon 110 relative to the vertical face 175. In place of a beveled washer, however, the tube 140 itself may be beveled as shown in FIG. 8.

It will be appreciated that the end result is a superior structure that achieves maximum stability. Load in the form of tension, generally designated by the letter "F", is thus directed into the hill 170 from one-component to the next according to the following sequence:

1) tendon 110

2) adhesive material within the tube 140, 3) tube 140

4) plate 130

5) studs 160

6) final concrete facing 190.

The final concrete facing 190 acts to secure the surrounding substrate along the vertical face 190, thus preventing the formation 170 from sloughing over.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. The claims are thus to be understood to include what is specifically illustrated and described above, what is conceptionally equivalent, what can be obviously substituted and also what essentially incorporates the essential idea of the invention.

What is claimed is:

1. A soil nail apparatus for stabilizing a formation having a face, comprising:

a tendon;

a plate having a near surface facing the face of the formation, a far surface opposite to the near surface, and a bore through which the tendon extends, the bore having a bore diameter;

a one-piece tube mounted to the tendon by an adhesive material contacting the tube and the tendon, the tube being disposed adjacent to the bore of the plate such that a portion of the tendon extends through the bore of the plate and into the tube, the tube,having an outer diameter greater than the bore diameter, the tube being disposed exterior to the formation and adjacent to the far surface of the plate;

the adhesive material disposed within the tube; and an anchor coupled to the plate.

2. The soil nail apparatus of claim 1 wherein the tendon comprises a non-metallic material.

3. The soil nail apparatus of claim 2 wherein the non-metallic material comprises a fiber reinforced polymer material.

4. The soil nail apparatus of claim 3 wherein the tendon comprises a single strand of fiber reinforced polymer material.

5. The soil nail apparatus of claim 3 wherein the tendon comprises multiple strands of a fiber reinforced polymer material.

6. The soil nail apparatus of claim 1 wherein the tendon comprises a metallic material.

7. The soil nail apparatus of claim 1 wherein the tendon has a non-threaded surface.

8. The soil nail apparatus of claim 7 wherein the tendon has a smooth surface.

9. The soil nail apparatus of claim 7 wherein the tendon has a deformed surface.

10. The soil nail apparatus of claim 1 wherein the bearing plate and the tube comprise a non-metallic material.

11. The soil nail apparatus of claim 10 wherein the non-metallic material comprises a fiber reinforced polymer material.

12. The soil nail apparatus of claim 1 wherein the tube includes a plurality of injection ports defined in a side wall.

13. The soil nail apparatus of claim 1 wherein the tube comprises a deformed inner surface.

14. The soil nail apparatus of claim 1 wherein the tube comprises an end cap with an exit aperture.

15. The soil nail apparatus of claim 1 wherein the adhesive material is epoxy.

16. The soil nail apparatus of claim 1 wherein the adhesive material is cementitious grout.

17. The soil nail apparatus of claim 1 wherein the anchor comprises a headed stud coupled to a far surface of the plate.

18. The soil nail apparatus of claim 1 further comprising a final concrete facing encapsulating the tube, the plate, and the anchor.

19. A heading device for securing a soil nail to be inserted into a formation having a face, the heading device comprising:

a non-metallic plate having a near surface, a far surface, and a bore with a bore diameter;

a hollow one-piece non-metallic tube with an outer diameter greater than the bore diameter, the tube being coupled to the plate and disposed adjacent to the far surface and the bore of the plate such that the tube is disposed exterior to the formation;

an adhesive material disposed within the tube for coupling the tube exterior to the formation and bore; and a non-metallic anchor coupled to the far surface of the plate.

20. The heading device of claim 19 wherein the nonmetallic anchor comprises a headed stud.

21. The heading device of claim 19 wherein the non-metallic plate, the non-metallic tube, and the non-metallic anchor comprise a fiber reinforced material.

22. A method for stabilizing a formation having a substantially vertical face, the method comprising:

forming a hole into the formation via the substantially vertical face;

inserting a tendon into the hole with an exposed portion of the tendon protruding out from the hole;

filling the hole with grout;

placing a plate over the exposed portion of the tendon;

disposing a one-piece tube exterior to the formation and over the exposed portion of the tendon; and fixing the tube to the exposed portion of the tendon by filling the tube with an adhesive material.

23. The method in claim 22 further comprising deforming a surface of the tendon.

24. The method in claim 22 further comprising deforming an inner surface of the tube.

25. The method in claim 22 further comprising forming the tendon out of a fiber reinforced polymer material.

26. The method in claim 25 wherein forming the tendon comprises grouping multiple strands of a fiber reinforced polymer material.

27. The method in claim 22 further comprising placing a final concrete facing over the plate, tube, and stud.

28. The method in claim 22 wherein filling the tube with an adhesive material comprises injecting the adhesive material into the tube via injection ports on a side wall of the tube.

29. The method in claim 22 wherein filling the tube with an adhesive material comprises placing adhesive material into the tube prior to disposing the tube over the exposed portion of the tendon.

30. A method for stabilizing a formation having a substantially vertical facing, the method comprising:

inserting a soil nail into a hole in the formation via the vertical facing;

exerting load into the hill formation with the soil nail;

transferring load from the soil nail to an adhesive material disposed on a portion of the soil nail protruding from the hole in the formation;

transferring load from the adhesive material to a one-piece tube disposed exterior to the formation and over the protruding portion of the soil nail by direct contact between the adhesive and the one-piece tube; and transferring load from the tube to a plate disposed adjacent to the soil nail.

31. The method in claim 30 further comprising transferring load from the plate to an anchor coupled to the plate.

32. The method in claim 31 further comprising transferring load from the anchor to a final concrete facing embedding the anchor.

33. The method in claim 32 further comprising transferring load from the final concrete facing toward the vertical facing of the hill formation.

34. A method for stabilizing a formation having a substantially vertical face, the method comprising:

forming a hole into the formation via the substantially vertical face;

inserting a tendon into the hole with an exposed portion of the tendon protruding out from the hole;

filling the hole with grout;

placing a plate over the exposed portion of the tendon;

disposing a tube exterior to the formation and over the exposed portion of the tendon; and filling the tube with an adhesive material; wherein filling the tube with an adhesive material comprises placing adhesive material into the tube prior to disposing the tube over the exposed portion of the tendon.

* * * * *